United States Patent [19]

Kuehling

[11] Patent Number: 4,554,818

[45] Date of Patent: Nov. 26, 1985

[54] MANUAL CABLE CLAMP CLOSURE

[75] Inventor: Guenter F. Kuehling, Berwyn, Ill.

[73] Assignee: Allied Corporation, Morris Township, Morris County, N.J.

[21] Appl. No.: 528,676

[22] Filed: Sep. 1, 1983

[51] Int. Cl.[4] ..... B21D 7/06; B21D 53/36

[52] U.S. Cl. ..... 72/410; 72/452; 29/751; 269/157; 269/229; 74/526; 74/527

[58] Field of Search ..... 72/410, 409, 452; 29/751, 237; 81/126, 128, 91 R; 269/229, 238, 157, 207; 74/526, 527

[56] References Cited

U.S. PATENT DOCUMENTS

| | | | |
|---|---|---|---|
| 379,998 | 3/1888 | Stanwood et al. | 74/526 |
| 1,090,575 | 3/1914 | Shannon | 269/238 |
| 1,485,731 | 3/1924 | Stangbye | 269/157 |
| 2,199,932 | 5/1940 | Briggs et al. | 72/410 |
| 2,456,613 | 12/1948 | Archambault | 269/157 |
| 2,791,914 | 5/1957 | Cornelius | 74/527 |
| 2,858,707 | 11/1958 | Langridge et al. | 74/526 |
| 2,892,351 | 6/1959 | McCarty | 74/526 |
| 3,127,786 | 4/1964 | Wooley | 74/527 |

*Primary Examiner*—Daniel C. Crane

*Attorney, Agent, or Firm*—Roger H. Criss

[57] ABSTRACT

A manually-operable device for applying a clamping force to close a conventional deformable cable clamp of an electrical connector includes a base defining a first channel and a second channel transverse to the first channel, a shaft disposed and retained in the second channel, a camming mechanism mounted to the shaft in the first channel, and a handle attached to the shaft. A pair of jaws, pivotably mounted to the base are provided with facing cam surfaces, which are displaced outwardly by the camming mechanism when the handle is actuated to rotate the shaft, forcing opposed jaw portions together. The handle is mounted to the shaft by mounting mechanism, which carries a detent device, which cooperates with a detent recess in adjustable stop mechanism mounted to the base, to limit the movement of the handle and retain the handle in actuated position.

5 Claims, 5 Drawing Figures

MANUAL CABLE CLAMP CLOSURE

This application is directed to a manually-operable device for applying a clamping force. In particular, the application is directed to a manually-operatable device for applying a clamping or crushing force to a conventional deformable cable clamp of an electrical connector.

BACKGROUND OF THE INVENTION

Devices for applying closing or crushing forces to a cable clamp of an electrical connector are well-known. Such connectors typically have a body portion of elongated shape, and two rows of contacts extending the length of the body, to which wires of a cable are connected. At assembly, a cable is placed in a deformable or clampable cable clamp of the connector with the ends to be terminated adjacent the contacts, and the cable clamp is then squeezed to clamp it or crush it to retain the cable, before the individual wires of the cable are terminated to the individual contacts. To perform this function, a pair of opposed cylinders have heretofore been provided, and actuated in conventional fashion to clamp or crush the cable clamp. These cylinders may be maintained actuated to aid in retaining the connector in a terminating fixture, by immobilizing the cable where it enters the connector.

Such cylinders, while functional, required a time-consuming procedure to adjust, rendering them inappropriate for short production runs of particular connectors, and were also prone to develop leaks of actuating fluid, which, if hydraulic cylinders were used, contaminated the individual wires to be terminated, and, in the case of insulation-displacing contact sections, interfered with proper electrical connection. In addition, such mechanisms required a supply of pressurized fluid, increasing the heat and noise in the work place.

SUMMARY OF THE INVENTION

The instant invention provides a manually-actuatable apparatus for providing a clamping force, adapted for closing a cable clamp on a connector, which does not share these deficiencies of the prior art.

It is an object of the invention to provide a manually-operable device for applying a clamping force to a cable clamp of a conventional electrical connector.

The invention provides a base means defining a first channel and a second channel transverse to the first channel adapted to receive a shaft, the shaft being received in the second channel, and having camming means affixed to the shaft within the first channel, first and second jaw means pivotably mounted to the base means, the first and second jaw means having opposed cam surfaces urged against an actuating portion of the camming means, and including first and second clamping surfaces disposed facing each other and being moved towards each other when the first and second cam surfaces are moved by the actuating portion. Handle means are affixed to the shaft for rotating the shaft, and including mounting means carrying detent means which cooperate with a detent recess in a stop means adjustably affixed to the body means for limiting the motion of the handle and maintaining it in actuated position.

It is an advantage of the invention that a simple, compact and dependable mechanism is provided, without the necessity of noise and heat producing sources of mechanical energy, and without the use of actuating fluids which may leak and cause contamination, either by the leakage of an actuating fluid, or by the leakage of air under pressure and resultant distribution of dust, dirt and lubricating oil.

Other objectives, features and advantages of the invention will become apparent from the detailed description which follows.

DESCRIPTION OF THE PREFERRED EMBODIMENT

Similar identifying numbers for similar components will be used in the description of all figures, wherever possible.

Figure 4:
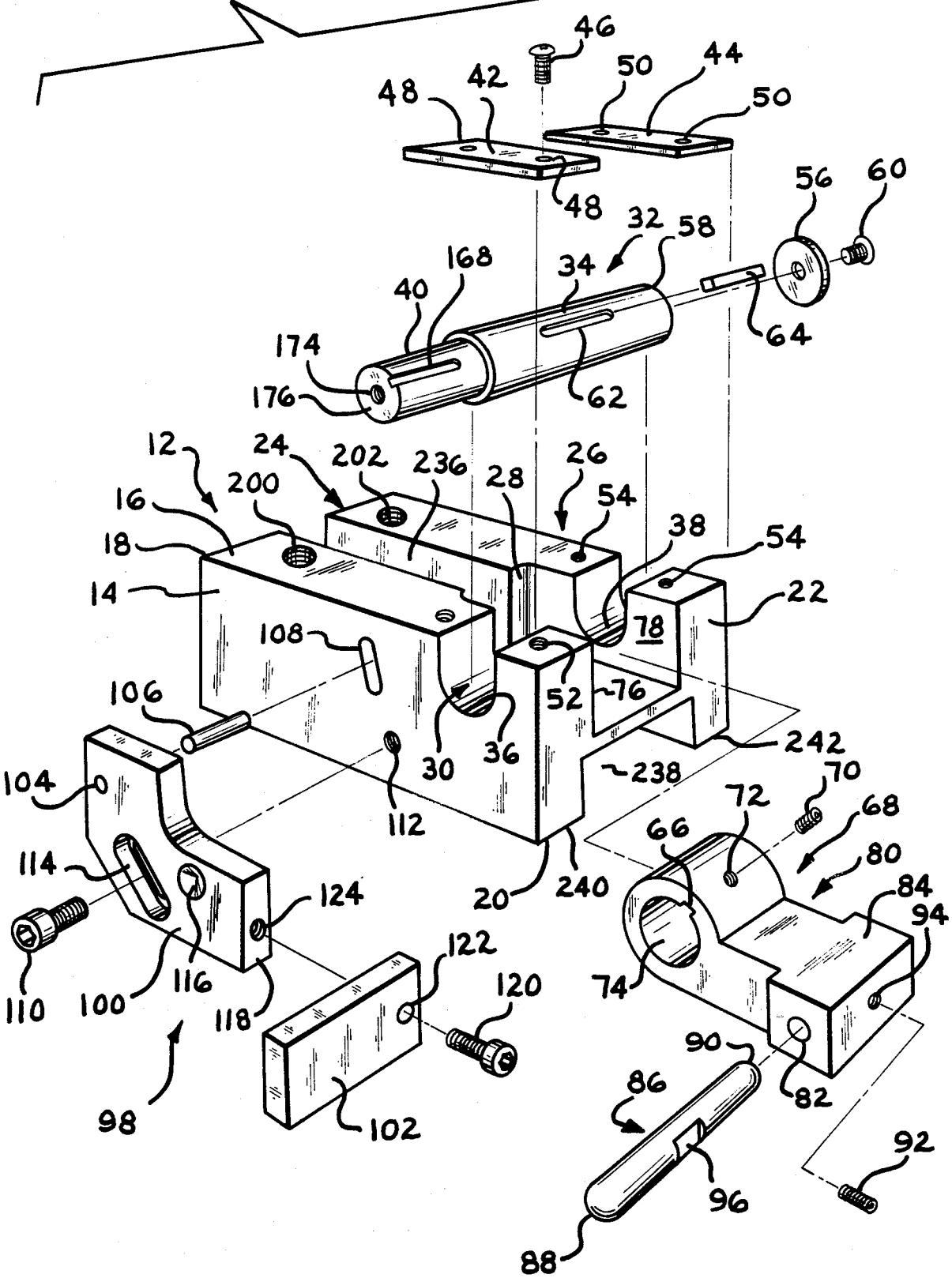
FIG. 4 is an exploded perspective view, illustrating a first stage in the assembly of the preferred embodiment of the invention.
Figure 5:
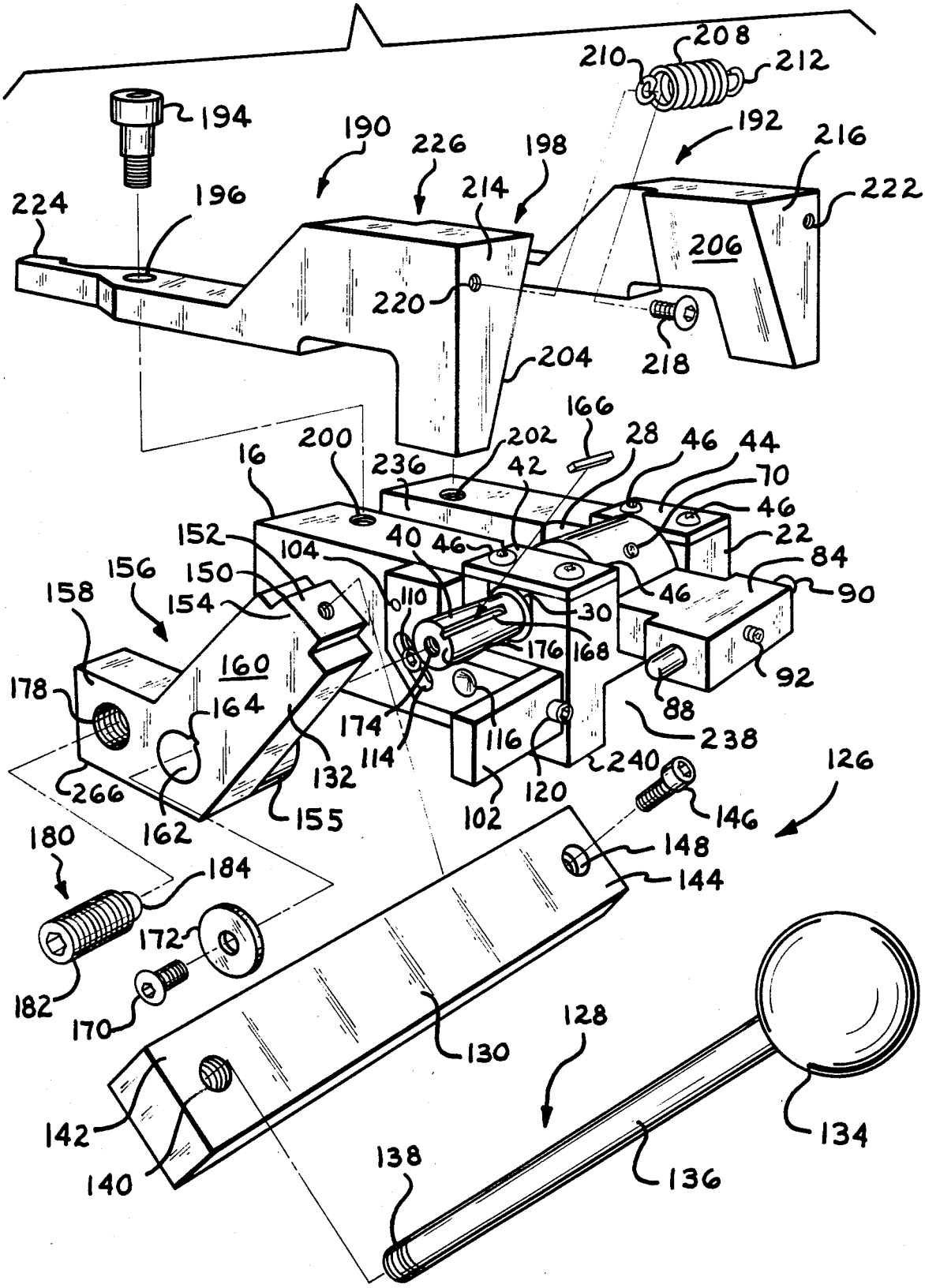
FIG. 5 is an exploded perspective view, showing a final stage in the assembly of the preferred embodiment of the invention.

Referring first to FIGS. 4 and 5, which illustrate the various components of the invention in unassembled and assembled form, it can be seen that apparatus 10 includes a base means 12 including at least first and second flat surfaces 14 and 16 meeting at a common line 18. Bottom surface 20, end surface 22, front surface 24 and surface 26 opposite surface 14 are also flat in the preferred embodiment of the invention, and define a base means 12 which is right rectangular in outline.

As illustrated, base means 12 includes a channel 28 extending parallel to common line 18, and extending to end surface 22 of base means 12. As illustrated, it also extends to front surface 24, for convenience in machining and mounting. As will become apparent, channel 28 is adapted to receive an actuating or camming means, described below, and need not be of sufficient dimension to receive the actuating or camming means throughout its entire length. Base means 12 further includes a second channel 30 transverse to channel 28 and extending between surface 16 and surface 26, adapted to receive a shaft 32 therein. Shaft 32 includes a cylindrical portion 34 which is received by rounded bottom portions 36 and 38 of channel 30, and, as illustrated, a smaller-diameter cylindrical portion 40, which, in assembled configuration, extends beyond first flat surface 14. As illustrated, shaft 32 is retained in channel 30 by retaining plates 42 and 44, which are retained against surface 16, converting channel 30, by mounting means shown as screw 46, passing through apertures 48 and 50 of retaining plates 42 and 44, and into threaded openings 52, 54 in surface 16. Shaft 32 is restrained from motion in a first direction by a washer 56, retained to end 58 of shaft 32 by fastening means shown as screw 60. As will be apparent, washer 56 bears against surface 26 to prevent this motion. Cylindrical portion 34 includes a keyway 62, for receiving a key 64, which cooperates with keyway 66 in camming means 68, for affixing camming means 68 to shaft 32. Camming means 68 is restrained from movement along shaft means 32 by a set screw 70 passing through aperture 72, and bearing either on cylindrical portion 34 or on key 64. As will be apparent, camming means 68 is installed on shaft 32, with cylindrical portion 34 passing through cylindrical aperture 74, so that camming means 68 will be disposed between walls 76, 78 of channel 28.

Camming means 68 includes an actuating portion 80 which, in assembled position, extends from end surface 22. As illustrated, actuating portion 80 is generally T-shaped and includes an aperture 82 extending through cross portion 84. A pin member 86, preferably of hardened steel, having first and second rounded ends 88 and 90 is inserted into aperture 82, and retained in aperture 82 by a set screw 92 inserted into threaded aperture 94 of cross member 84, and bearing against flat portion 96 defined in pin member 86.

Stop means 98 is adjustably affixed to surface 14, and includes a detent portion member 100 and a stop portion member 102. Detent portion member 100 includes an aperture 104, into which a pin 106 is pressed. Pin 106 is movable in elongated slot 108 in first flat surface 14, and is pivotably retained to surface 14 by a fastening means shown as screw 110, which threadably engages an aperture 112 in surface 14. Screw 110 passes through recessed elongated slot 114 in detent portion 100, so that detent portion member 100 may be adjusted with respect to surface 14. Detent portion 100 further defines a detent recess means 116, for cooperating with a detent mechanism, further described below. Stop portion member 102 is retained to an end surface 118 of detent portion member 100 by a screw 120, passing through aperture 122 in stop portion member 102, and engaging threaded aperture 124 in surface 118.

Handle means 126 includes an actuating rod portion 128, an offsetting bar portion 130 and an actuating portion 132. Actuating rod portion 128, as illustrated, includes a conventional handle ball 134, and a rod portion 136 having a threaded end 138 which engages threaded aperture 140 at first end 142 of offsetting bar portion 130. Second end 144 of offsetting bar portion 130 is retained to actuating portion 132 by fastening means shown as screw 146 which passes through aperture 148 in second end 144, and into threaded aperture 150 in end surface 152 of actuating portion 132. As illustrated, end surface 152 is defined by a keying portion 154, which cooperates with a keying slot, not shown, in second end 144 of offsetting bar portion 130, to prevent the rotation of offsetting bar portion 130 with respect to actuating portion 132. As shown, actuating portion 132 includes a spacer portion 155, and a generally L-shaped body portion 156, which includes a detent retaining portion 158, a lever portion 160, and a cylindrical aperture 162, which in turn includes a keyway 164. A key 166 engages keyway 164 and a keyway 168 defined in cylindrical portion 40 of shaft 32 when cylindrical aperture 162 is installed over cylindrical portion 40 to prevent relative rotation between shaft 32 and actuating portion 132. Actuating portion 132 is retained to shaft 32 by fastening means shown as screw 170 passing through washer 172 and into threaded aperture 174 in end 176 of shaft 32.

Detent retaining portion 158 of actuating portion 132 includes a threaded aperture 178 into which a conventional detent mechanism 180, having a threaded body 182 and a spring-loaded detent ball or pin 184 is threadably engaged. As will be apparent, detent ball or pin 184 cooperates with detent recess 116 when apparatus 10 is in engaged position.

First jaw means 190 and second jaw means 192 are pivotably mounted to surface 16 distal to surface 22 by means of fastening means shown as a shoulder screw 194, passing through apertures 196, 198 in first and second jaw means 190, 192, and into threaded apertures 200, 202 in surface 16. First jaw means 190 includes a first cam surface 204, and second jaw means 192 includes a second cam surface 206. Surfaces 204 and 206 are disposed facing each other, and, in assembled position, resiliently urged against ends 88, 90 of pin 86 of actuating portion 84 by a spring means 208 having end loop portions 210, 212 retained respectively to end surfaces 214, 216 by fastening means shown as screw 218 passing through a respective loop 210, 212 and into a respective threaded aperture 220, 222. As can be seen surfaces 204, 206 will be moved apart from each other when shaft 32 is rotated to move actuating portion 84 towards surface 16. This relative motion of surfaces 204, 206 will in turn cause respective first and second clamping surfaces 224 and 226 of jaw means 190, 192 to move towards each other and apply a clamping force to an item disposed between them.

Figure 1:
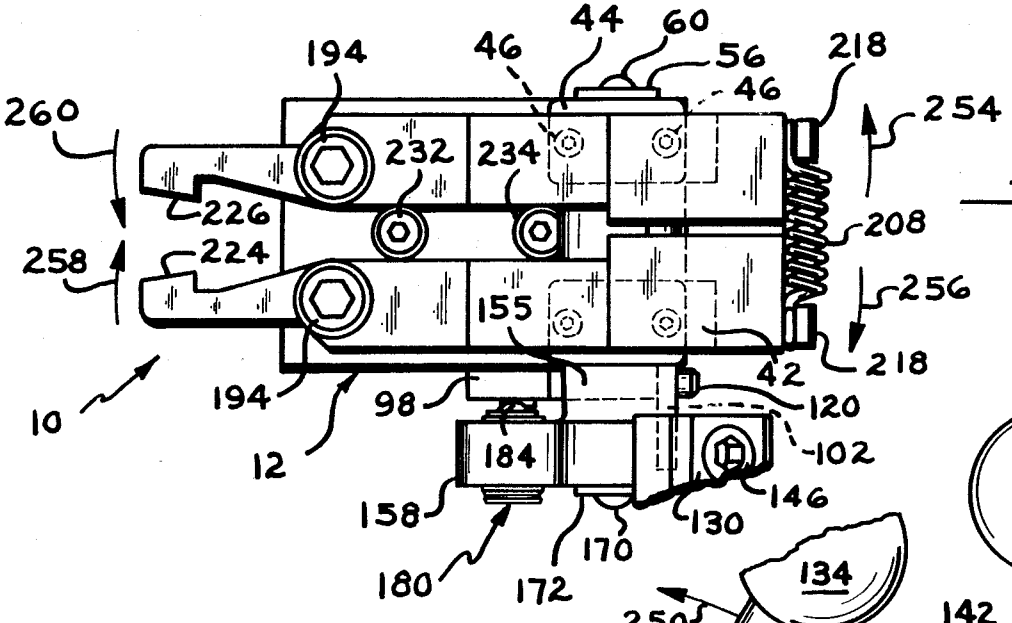
FIG. 1 is a top view of the preferred embodiment of the invention.
Figure 2:
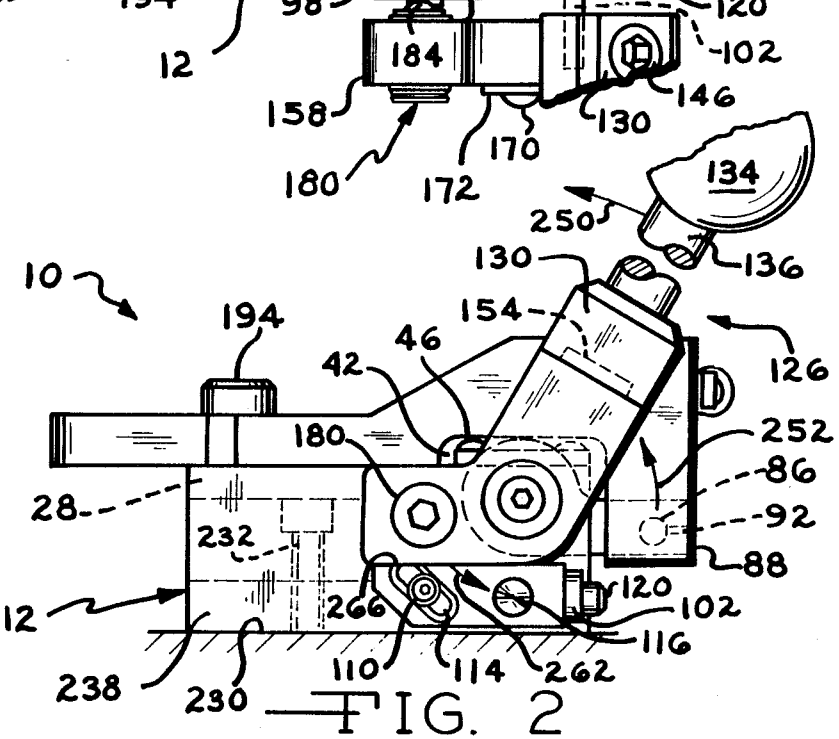
FIG. 2 is a side elevational view of the preferred embodiment of the invention.
Figure 3:
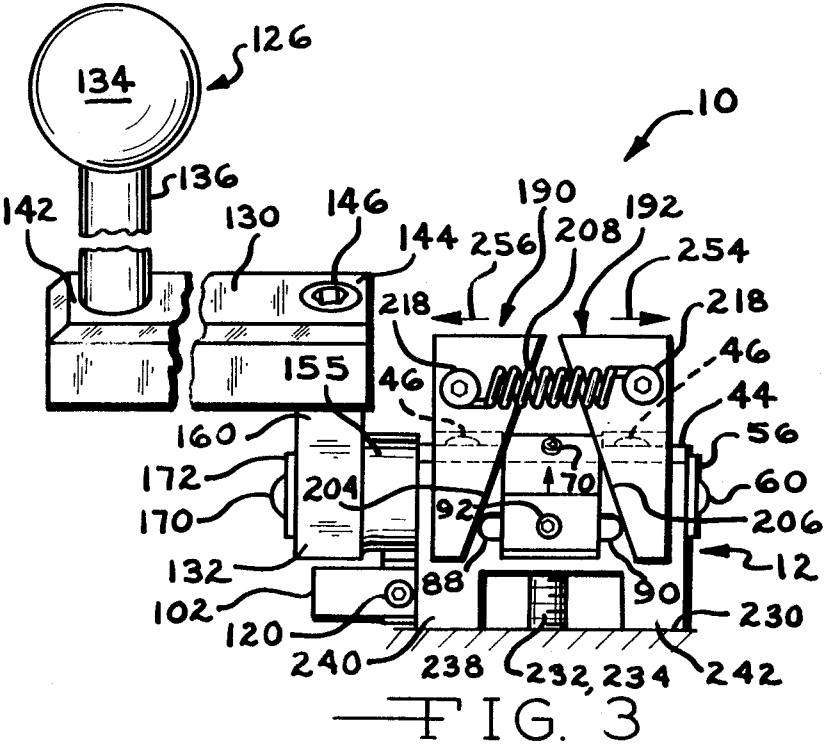
FIG. 3 is a rear elevational view of the preferred embodiment of the invention.

Apparatus 10 is illustrated in assembled form in FIGS. 1–3, and may be retained to a mounting surface 230 such as by screws 232, 234. As will be apparent from FIG. 2, channel 28 serves to recess the heads of screws 232, 234, so that they will not interfere with jaw means 190, 192. Also, as will be apparent, channel 28, as illustrated, is not of uniform width or depth, being wider and deeper in the area where it accommodates camming means 68 than in the area were it accommodates the heads of screws 232, 234. As will be apparent, this variation in depth and width is relatively unimportant, since any desired width or depth may be used in portion 236 to accommodate the heads of screws 232, 234, as long as an adequate thickness of material is provided under the heads of screws 232, 234, for strength. Also, as can be seen in the figures, base member 12 defines a channel 238 in its bottom surface 20, for convenience in machining, since, it is more difficult to machine a perfectly flat large surface than to define separate mounting feet portions such as 240, 242 by machining channel 238 in surface 20.

Referring again to FIGS. 1–3, it can be seen that if handle 126 is moved in the direction of arrow 250, camming means 68, including pin member 86, will move in the direction of arrow 252, causing surfaces 204, 206 to move apart in the direction of arrows 254, 256, which causes jaw means 190, 192 to pivot about shoulder screws 194, causing surfaces 224, 226 to move towards each other in the direction of arrows 258, 260. Simultaneously, detent mechanism 180 will move towards detent recess means 116 in the direction of arrow 262. As ball or pin member 184 engages detent recess means 116, surface 266 of actuating portion 132 will lie adjacent stop portion member 102, so that actuating portion 132 will be maintained at the limit of its travel. Since stop means 98 may be adjusted by loosening screw 110 and moving pin 106 in elongated slot 108, the minimum distance between first clamping surface and second clamping surface 224 and 226 may be easily adjusted, to maintain a clamping force on an object interposed between surfaces 224 and 226.

As will be apparent to one skilled in the art, numerous variations of the structure of the illustrated embodiment of the invention may be made, without departing from the spirit and scope of the claimed invention.

I claim:

1. An apparatus for applying a clamping force to a cable clamp of an electrical connector, comprising:

a base means, said base means having at least first and second surfaces meeting along a common line, a first channel defined in said first surface parallel to said common line and extending to a first end of said base means, a second channel transverse to said first channel and extending between two sides of said base means, said second channel receiving a shaft therein;

said shaft having a first portion being received in said second channel and bridging said first channel and being restrained from movement transverse to said shaft by retaining means affixed to said first surface and bridging portions of said second channel;

camming means affixed to a portion of said shaft disposed within said first channel and rotating therewith, said camming means having an actuating portion extending from said first channel and beyond a third surface of said base means, said third surface being transverse to said first and second surfaces;

first and second jaw means pivotably mounted to said first surface distal to said third surface for movement parallel to said first surface to clamp said cable clamp;

said first jaw means having a first cam surface, and said second jaw means having a second cam surface, said first and second cam surfaces being disposed facing each other and in contact with and being resiliently urged against said actuating portion and being adapted to be moved apart by said actuating portion when said shaft is rotated to move said actuating portion towards said first surface;

said first jaw means and said second jaw means including respective first and second clamping surfaces, said first and second clamping surfaces being disposed facing each other and being moveable towards each other when said first and second cam surfaces are moved towards said first surface to provide said clamping force;

handle means affixed to said shaft for rotating said shaft;

stop means adjustably affixed to said second surface adjacent said second channel for limiting the motion of said handle means and including detent cavity means;

said handle means including mounting means for affixing said handle means to said shaft;

said mounting means including detent means adapted to cooperate with said detent cavity means and retain said handle means in a first position for releasably maintaining said clamping force.

2. The apparatus of claim 1, wherein said retaining means includes first and second plate members fastened to said first surface and bridging first and second portions of said second channel.

3. The apparatus of claim 2, wherein said first and second cam surfaces are resiliently urged against said actuating portion by a spring connected between said first and second jaw means.

4. The apparatus of claim 3, wherein said base means further includes a third channel defined in a fourth surface of said base means opposite said first surface, said third channel defining spaced mounting portions.

5. The apparatus of claim 4, wherein said first and second surfaces are flat surfaces.

* * * * *